US005439206A

United States Patent [19]

Raasch et al.

[11] Patent Number: 5,439,206

[45] Date of Patent: Aug. 8, 1995

[54] PRODUCT DELIVERY SYSTEM FOR A PRINTING-PRESS FOLDER

[75] Inventors: Gerd Raasch, Sandhausen; Richard Mack, Brühl, both of Germany

[73] Assignee: Heidelberger Druckmaschinen, Heidelberg, Germany

[21] Appl. No.: 168,680

[22] Filed: Dec. 16, 1993

[30] Foreign Application Priority Data

Dec. 16, 1992 [DE] Germany ..... 42 42 542.5

[51] Int. Cl.[6] ..... B41F 13/58

[52] U.S. Cl. ..... 270/8; 270/21.1; 493/440

[58] Field of Search ..... 270/6, 10, 19, 38, 42, 270/21.1, 5, 8; 493/358, 416, 436, 440; 271/184, 200, 303

[56] References Cited

U.S. PATENT DOCUMENTS

| | | | |
|---|---|---|---|
| 2,019,658 | 11/1935 | Crafts | 270/8 X |
| 2,540,972 | 2/1951 | Wagner, Jr. et al. | 271/303 X |
| 3,264,917 | 8/1966 | Califano et al. | 271/303 X |
| 4,368,879 | 1/1983 | Hoshi | 270/6 |
| 4,564,470 | 1/1986 | Schmitt | 270/5 X |
| 4,754,959 | 7/1988 | Kobler et al. | 270/21.1 |
| 5,037,076 | 8/1991 | Stab | 270/6 X |

*Primary Examiner*—John E. Ryznic

*Attorney, Agent, or Firm*—Herbert L. Lerner; Laurence A. Greenberg

[57] ABSTRACT

Product delivery system for a printing-press folder having a cutting unit for dividing printed webs of material into a multiplicity of printed copies or signatures, and a gripper cylinder includes a device for alternatively feeding cross-folded copies from the gripper cylinder to a device for producing a second longitudinal fold and to delivery units disposed down-line therefrom, on the one hand, and to a further chargeable delivery unit for cross-folded copies, on the other hand, the copy delivery units being chargeable facultatively in accordance with a respective production mode, the alternative feeding device including a first conveyor surface formed of delivery belts encompassing a 90°-turn, a second conveyor surface disposed within the folder and formed of a conveyor belt, and a swivelable diverter for selectively delivering copies alternatively onto the first conveyor surface and onto the second conveyor surface, the swivelable diverter being connectible with a stacker.

6 Claims, 3 Drawing Sheets

PRODUCT DELIVERY SYSTEM FOR A PRINTING-PRESS FOLDER

SPECIFICATION

The invention relates to a product delivery system for a printing-press folder and, more particularly, to such a product delivery system having a cutting unit for dividing printed webs of material into a multiplicity of products constituting printed copies or signatures, and a gripper cylinder, and including a device for alternatively feeding cross-folded copies from the gripper cylinder to a device for producing a second longitudinal fold and to delivery units disposed down-line therefrom, on the one hand, and to a further chargeable delivery unit for cross-folded copies, on the other hand.

From the published German Patent Document 29 21 383 C2, a paper-folding machine for use with a rotary printing press has become known heretofore. After passing through a cutting unit, individual copies are received by a triple-sized collection cylinder, down-line from which two additional double-sized folding cylinders are disposed. From an upper double-sized folding cylinder, the copies are transported in a decelerating belt train formed of two conveyor-belt pairs revolving at different belt speeds. The copies are decelerated therein and reach a pile which continually descends or sinks during the production process. No possibility of further transporting the copies from this quiescent or static copy output is provided for in this publication.

If the copies are taken up from below the double-sized folding cylinder, however, they are fed to a device for producing a second longitudinal fold. Depending upon whether copies with or without a second longitudinal fold should be produced, the copies arrive into differently oriented paddle wheels. If copies without a second longitudinal fold are produced, they are transported via a paddle wheel to a conveyor-belt train in a stacker and arranged edgewise therein. If the copies are produced with a second longitudinal fold, however, the stacker must be turned at least 90° in order to cooperate with the paddle wheel assigned to this type of copy. In the environment of the folder, accordingly, adjusting areas or surfaces corresponding to all conceivable stacker positions are additionally necessary. In this regard, it should be noted that, in the construction of the German publication, no further transport of copies from the upper delivery unit is possible.

U.S. Pat. No. 4,986,730 discloses a stacker associated with a processing machine located up-line therefrom and with which flat products or sheet-like articles are fed at an angle of 45° against stops of the stacker and, in this manner, orient or align themselves on the pile to be formed. A conveyor system disclosed in this U.S. patent permits the copies to be fed also only on one transport plane; because it is aligned only on one copy transport path, it is of little advantage for other delivery possibilities at one and the same processing machine, due to the fact that it is too inflexible. One of the systems disclosed in U.S. Pat. No. 4,986,730 would thus be required at each of several copy deliveries of a processing machine. In addition to the demand placed on more expensive adjusting areas, avoidable costs result.

It is accordingly an object of the invention to provide a product-delivery system for a printing-press folder which avoids all of the foregoing disadvantages of heretofore known systems of this general type.

With the foregoing and other objects in view, and starting from the aforedescribed state of the art, there is provided, in accordance with the invention, a product delivery system for a printing-press folder including a cutting unit for dividing printed webs of material into a multiplicity of printed copies or signatures, and a gripper cylinder, comprising means for alternatively feeding cross-folded copies from the gripper cylinder to a device for producing a second longitudinal fold and to delivery units disposed down-line therefrom, on the one hand, and to a further chargeable delivery unit for cross-folded copies, on the other hand, the copy delivery units being chargeable facultatively in accordance with a respective production mode, the alternative feeding means comprising a first conveyor surface formed of delivery belts encompassing a 90°-turn, a second conveyor surface disposed within the folder and formed of a conveyor belt, and means comprising a swivelable diverter for selectively delivering copies alternatively onto the first conveyor surface and onto the second conveyor surface, the swivelable diverter being connectible with a stacker.

The advantages derivable from the foregoing construction in accordance with the invention is that now one defined position of the stacker or pile unit is sufficient for further processing all suitable copies. Extensive and tortuous conveyor or transport paths, which are prone to disruption or failure, as well as require many adjusting areas, and which impede access to the copy deliveries of the folder, may be dispensed with, because the conveyor surfaces according to the invention are located in a lower part of the folder. Because both conveyor surfaces can be connected with the stacker via the swivelable diverter or gate, both a 4×4 or 16-side production, either once longitudinally and cross-folded copies or copies formed with a second longitudinal fold, as well, are able to be delivered and fed to a stacker, without any problem.

In accordance with another feature of the invention, one of the delivery belts of the first conveyor surface is curved, the conveyor belt of the second conveyor surface and the one curved delivery belt of the first conveyor surface having outlets located opposite the swivelable diverter of the stacker, the outlets being disposed above one another.

In accordance with a further feature of the invention, the swivelable diverter is selectively swivelable alternatively to the first and the second conveyor surfaces in dependence upon the copy delivery unit to be charged with copies.

In accordance with an added feature of the invention, the product delivery system includes a web drawing system having a drive, a first longitudinal folding device disposed up-line from the drive, the first longitudinal folding device being displaceable perpendicularly to a travel direction of a web of material for correcting a copy position.

In accordance with an additional feature of the invention, the product delivery system includes a longitudinal folding module, one of the copy delivery units, in a given position thereof, being disposed down-line from the longitudinal folding module.

In accordance with a concomitant feature of the invention, the longitudinal folding module comprises a plurality of conveyor belts, and one of the conveyor belts of the first conveyor surface is displaceable from one to another alternative position, so that, in the given position of the one copy delivery unit, and in the other alternative position of the one conveyor belt of the first conveyor surface, conveyed copies are feedable via the one conveyor belt of the first conveyor surface, to the stacker.

Thus, one copy delivery unit is disposed down-line from the longitudinal folding module. Copies conveyed into this one down-line copy delivery unit via conveyor belts of the longitudinally folding module, are feedable to a processing unit, via a conveyor belt arranged in an alternative position in the first conveyor surface. This permits a realization of the copy delivery concept even for folders with differently arranged paddle wheels.

Other features which are considered as characteristic for the invention are set forth in the appended claims.

Although the invention is illustrated and described herein as embodied in a product-delivery system for a printing-press folder, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

DESCRIPTION OF THE PREFERRED EMBODIMENTS

Figure 1:
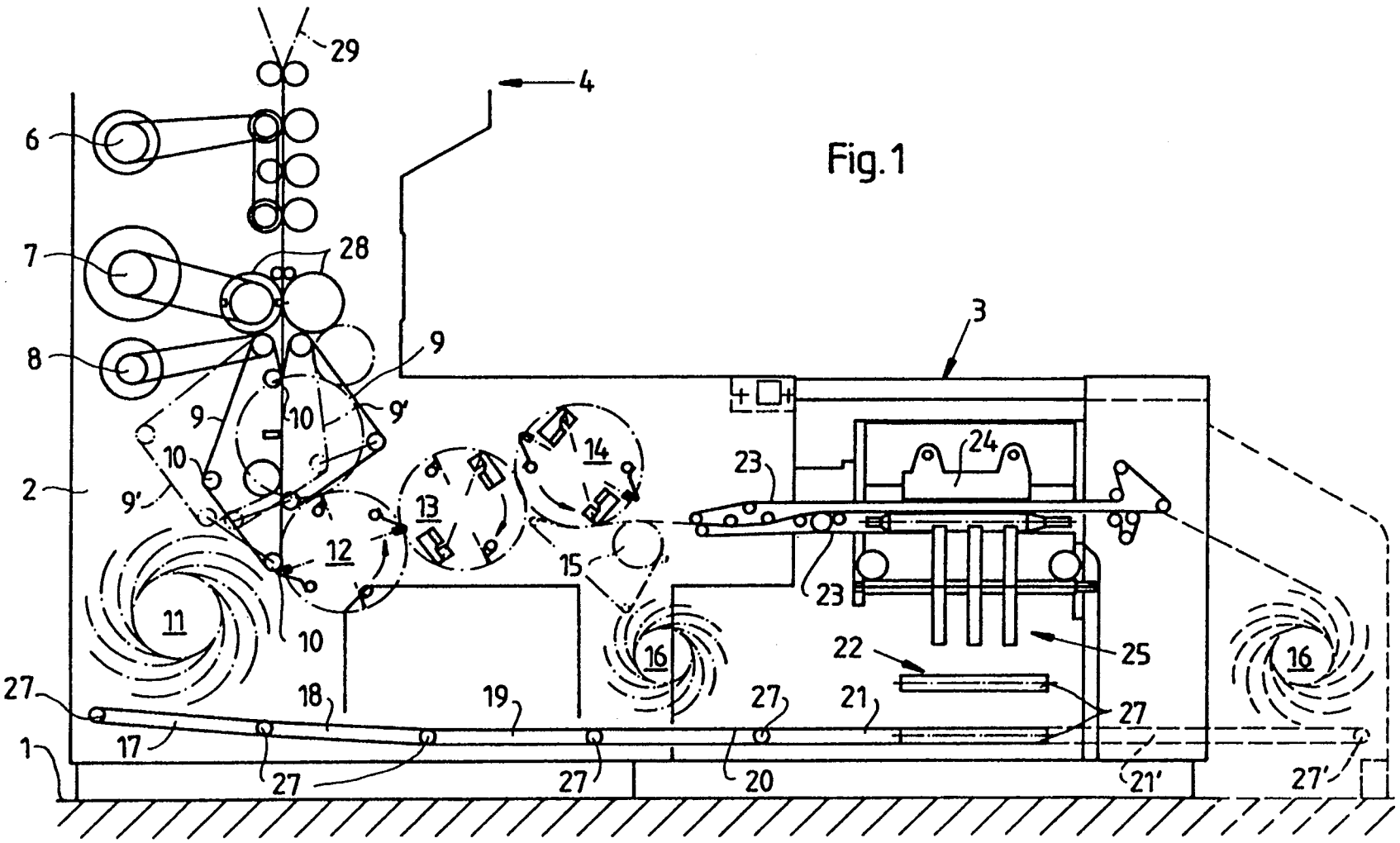
FIG. 1 is a diagrammatic side elevational view of a folder supported on a foundation and having a second longitudinal folding module.
Figure 1A:
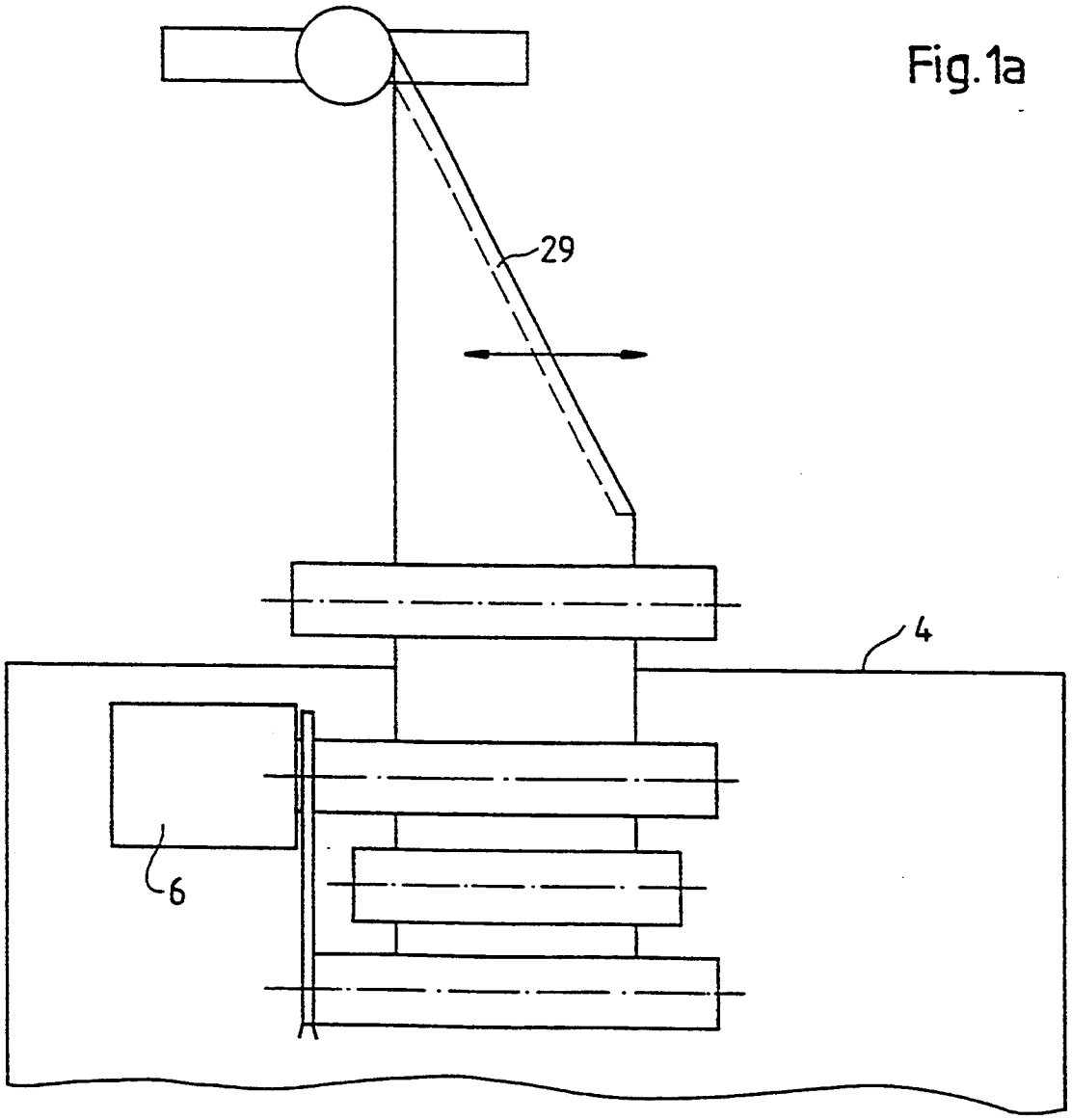
FIG. 1*a* is a view of the top portion of FIG. 1 rotated by 90 and as seen from the left-hand side of FIG. 1.

Referring now to the drawing and, first, particularly to FIG. 1 thereof, there is shown therein a folder base frame 2 supported on a foundation 1 and encompassing a second longitudinal folding module 3, as well as a superstructure 4 mounted up-line of the folder base frame 2 and having a first longitudinal folding device 29 mounted so as to be laterally displaceable therein. Due to the lateral displaceability of the first longitudinal folding device 29, the position of the copies on the peripheral surface of cross-fold cylinders 12, 13 and 14 is able to be varied. In other words, the first longitudinal folding device 29 is displaceable perpendicularly to a travel direction of a material web for correcting a copy position. A drive 6, by which a draw-roller pair infeeding a material web is driven, is located below the superstructure 4. A cutting unit 28, in turn, is disposed down-line from the draw-roller pair, and serves for subdividing the material web into a multiplicity of printed copies or signatures. The cutting unit 28 is also driven by its own drive 7. The individual copies severed from the material web arrive on conveyor belts 9 extending below the cutting unit 28 and revolving around reversing rollers 10. The conveyor belts 9 are drivable by a drive 8 and are able to be brought into a swung-away position 9' thereof represented in phantom, so that copies are feedable to individual pockets of a paddle wheel 11. The copies, which are produced in an operating mode of 4×4 or 16 sides, for example, are deposited on a delivery belt 17 which forms part of a first transport or conveyor plane or surface.

If the conveyor belts 9 remain in the position thereof represented by solid lines, the individual copies separated in the cutting unit 28 are fed to the cross-fold cylinders 12, 13 and 14. The latter cylinders include a gripper cylinder 12 carrying tucker or folding blades and gripper bars, and a folding-jaw cylinder 13 furnished with tucker or folding blades and folding jaws. A gripper cylinder 14 mounted down-line from the folding-jaw cylinder 13 is equipped with gripper bars and folding jaws, which do not form any part of the invention herein, however. A conveyor roller-pair 15 is disposed down-line from the gripper cylinder 14. If copies are produced without any second longitudinal fold, they travel from the conveyor roller-pair 15 into a paddle wheel 16 disposed therebelow. Below the paddle wheel 16, is a delivery belt 20 which, in turn, is part of the first transport surface, and is connected by delivery belts 18 and 19 with the hereinaforementioned delivery belt 17.

On the other hand, if the copies are to be produced with a second longitudinal fold, a transfer of the copies from the conveyor roller-pair 15 to conveyor belts 23 occurs, and the cross-folded copies are conveyed thereby into the second longitudinal folding module 3. By means of a reciprocatingly movable chopper blade 24 located above the conveyor belts 23, the copies are thrust into folding rollers to form the second longitudinal fold, and proceed therefrom into a paddle wheel 25 located below the folding rollers and disposed at an angle of 90° to the paddle wheel 16. Below the paddle wheel 25, a delivery belt 22 is located, forming the second conveyor plane or surface and serving for the delivery of the longitudinally folded copies.

Accordingly, for example, the delivery of a 4×4 or 16-side production occurs via the paddle wheel 11 onto a delivery belt 17 of a first conveyor plane or surface, as well as the delivery of copies provided with only a first longitudinal fold and further cross-folds via the paddle wheel 16 onto the deliver belt 20 of the first conveyor plane or surface. The first conveyor plane or surface formed of the delivery belts 17, 18, 19 and 20, as well as the curved delivery belt 21, terminates at the lower belt roller 27 shown in FIG. 1. The lower belt roller 27 forms an intersection location or interface of the folder with a further processing unit, such as a stacker 5, for example, disposed down-line therefrom. The delivery of copies formed with a second longitudinal fold occurs via the paddle wheel 25 onto the second conveyor surface having an intersection location or interface with a further processing unit formed by another belt roller 27 lying above the aforementioned belt roller 27.

Figures 2, 3:
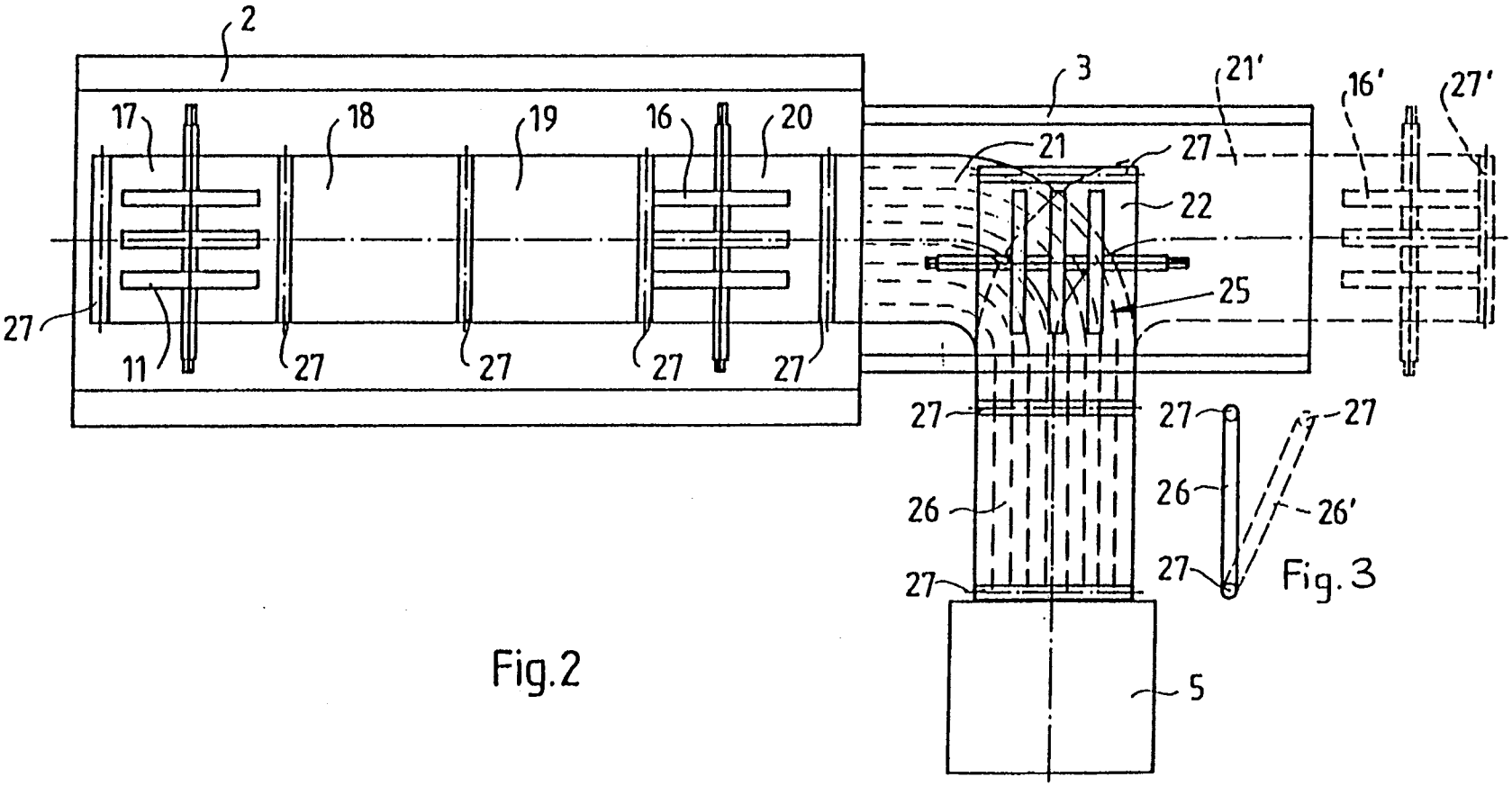
FIG. 2 is a top plan view of conveyor planes or surfaces extending within the folder of FIG. 1 below copy delivery units thereof, and which are connectible with a stacker unit.
FIG. 3 is a fragmentary side view of FIG. 2 showing an adjustable connection between the conveyor surfaces and the stacker unit.

FIG. 2 is a top plan view of transport planes or surfaces extending within the folder of FIG. 1 below copy delivery units thereof, and which are connectible with a stacker unit.

The first conveyor surface formed of the delivery belts 17, 18, 19 and 20, as well as the curved delivery belt 21, extends mainly in the folder base frame 2. The curved delivery belt 22 comprises a plurality of conveyor belts. In the second longitudinal folding module 3, the curved conveyor belt 21 of the first conveyor surface, as well as the conveyor belt 22 located there-above and forming the second conveyor surface below the paddle wheel 25, mutually overlap. The delivery belt 22, as well as the curved delivery belt 21, terminate at the belt rollers 27 arranged vertically above one another and forming the intersection locations or interfaces with the further processing unit, such as the stacker 5, for example. At the stacker 5, a swivelable gate or diverter 26 is located which is swivelable about a belt roller 27, as illustrated in the side view of FIG. 3, wherein the gate 26 is shown swivelable between the solid-line representation thereof and the broken-line position 26' thereof. The first conveyor surface, as well as the second conveyor surface, are connectible thereby with the stacker 5. The swiveling of the gate or diverter 26 into the one or the other positions thereof shown in FIG. 3 is effected automatically in accordance with the respective production mode. Accordingly, the swivelable gate or diverter 26 is located at one of the conveyer rollers 27, in accordance with the respective mode of production, and takes over the copies conveyed in the respective conveyor plane or surface for further processing in the stacker 5.

From the top plan view of the folder base frame 2 and the longitudinal folding module 3 shown in FIG. 2, it is apparent, furthermore, that the positions of the paddle wheel 16 and the paddle wheel 25 are arranged rotated through an angle of 90° relative to one another. It is further apparent from FIG. 2 that the delivery belts 17, 18, 19, 20, 21 and 22 are received mainly in the folder base frame 2 and below the second longitudinal folding module 3, and do not require any additional adjusting surface in a pressroom or printshop. Only the swivelable gate or diverter 26, which is adjustable at the individual conveyor planes or surfaces, is located outside the folder.

Thus, 4×4 or 16-side tabloid copies or signatures, as well as copies produced with a delta fold, a parallel fold or a double parallel fold can be delivered in the first conveyor plane or surface, whereas cross-folded copies provided with a first longitudinal fold, as well as with a second longitudinal fold, can be delivered in the second conveyor plane or surface. For further processing these copies produced in various modes of production, no displacement of a further processing unit, such as the stacker 5, for example, which is disposed down-line, is therefore required. Because the stacker 5 remains in the once-only assumed and precisely oriented position thereof, costly adjustment work, as well as the make-ready times necessary therefor, are thus also eliminated.

We claim:

1. A product delivery system for a printing-press folder including a cutting unit for dividing printed webs of material into a multiplicity of printed copies or signatures, and a gripper cylinder, comprising means for alternatively feeding cross-folded copies from the gripper cylinder to a device for producing a second longitudinal fold and to delivery units disposed down-line therefrom, on the one hand, and to a further chargeable delivery unit for cross-folded copies, on the other hand, said copy delivery units being chargeable facultatively in accordance with a respective production mode, said alternative feeding means comprising a first conveyor surface formed of delivery belts encompassing a 90-turn, a second conveyor surface disposed within the folder and formed of a conveyor belt, and means comprising a swivelable diverter for selectively delivering copies alternatively onto said first conveyor surface and onto said second conveyor surface, said swivelable diverter being connectible with a stacker.

2. Product delivery system according to claim 1, wherein one of said delivery belts of said first conveyor surface is curved, said conveyor belt of said second conveyor surface and said one curved delivery belt of said first conveyor surface having outlets located opposite said swivelable diverter of the stacker, said outlets being disposed above one another.

3. Product delivery system according to claim 1, wherein said swivelable diverter is selectively swivelable alternatively to said first and said second conveyor surfaces in dependence upon said copy delivery unit to be charged with copies.

4. Product delivery system according to claim 1, including a web drawing system having a drive, a first longitudinal folding device disposed up-line from said drive, said first longitudinal folding device being displaceable perpendicularly to a travel direction of a web of material for correcting a copy position.

5. Product delivery system according to claim 1, including a longitudinal folding module, one of said copy delivery units, in a given position thereof, being disposed down-line from said longitudinal folding module.

6. Product delivery system according to claim 5, wherein said longitudinal folding module comprises a plurality of conveyor belts, and said swivelable diverter is formed with one of said conveyor belts of said first conveyor surface and is displaceable from one to another alternative position, so that, in said given position of said one copy delivery unit, and in said other alternative position of said one conveyor belt of said first conveyor surface, conveyed copies are feedable via said one conveyor belt of said first conveyor surface, to the stacker.

* * * * *